US008479650B2

(12) United States Patent
Peter

(10) Patent No.: US 8,479,650 B2
(45) Date of Patent: Jul. 9, 2013

(54) METHOD AND DEVICE FOR CONTROLLING THE TEMPERATURE OF INKING GROUPS AND DAMPENING SOLUTION OF AN OFFSET PRINTING PRESS

(75) Inventor: Kohnert Peter, Ependwöhrden (DE)

(73) Assignee: Platsch GmbH & Co.KG, Stuttgart (DE)

( * ) Notice: Subject to any disclaimer, the term of this patent is extended or adjusted under 35 U.S.C. 154(b) by 804 days.

(21) Appl. No.: 12/281,084

(22) PCT Filed: Mar. 16, 2007

(86) PCT No.: PCT/EP2007/002309

§ 371 (c)(1),
(2), (4) Date: Aug. 28, 2008

(87) PCT Pub. No.: WO2007/110156

PCT Pub. Date: Oct. 4, 2007

(65) Prior Publication Data

US 2009/0283003 A1 Nov. 19, 2009

(30) Foreign Application Priority Data

Mar. 24, 2006 (DE) ..... 10 2006 014 115
Jun. 20, 2006 (DE) ..... 10 2006 028 292

(51) Int. Cl.
*B41F 23/04* (2006.01)

(52) U.S. Cl.
USPC ..... 101/487; 101/349

(58) Field of Classification Search
USPC ..... 101/487
See application file for complete search history.

(56) References Cited

U.S. PATENT DOCUMENTS 5,189,960 A * 3/1993 Valentini et al. ..... 101/487
5,375,518 A 12/1994 Kurz (Continued)

FOREIGN PATENT DOCUMENTS

DE 19 53 590 A1 6/1971
DE 40 00 912 5/1991

(Continued)

OTHER PUBLICATIONS

International Search Report issued in corresponding International Application No. PCT/EP2007/002309 mailed Dec. 5, 2007.

*Primary Examiner* — Anthony Nguyen
(74) *Attorney, Agent, or Firm* — Lempia Summerfield Katz LLC

(57) ABSTRACT

The invention relates to a method and a device for the temperature control of inking groups (6) and dampening solutions of an offset printing press (2), wherein, in order to achieve the temperature control of the inking groups (6), a heat transfer medium that has previously been circulated by the inking groups (6) in a temperature control circuit of said inking group (34) is optionally cooled, and wherein, in order to achieve the temperature control of the dampening solution, the dampening solution that has previously been circulated by the inking groups (6) in a temperature control circuit of said inking group (34) is optionally cooled. In order to smoothen the temperature profile in the temperature control circuits of the inking group (34) and the dampening solution (64) and simultaneously reduce the amount of dampening solution contained in the dampening solution circuit (64), the invention proposes that a part of the heat transfer medium is cooled to a temperature below the set temperature of the dampening solution in the dampening system (8) and is brought into contact in a heat exchanger (42, 84) with a dampening solution from the dampening solution circuit (64).

25 Claims, 2 Drawing Sheets

U.S. PATENT DOCUMENTS

| | | | | |
|---|---|---|---|---|
| 5,611,278 | A * | 3/1997 | Garner et al. | 101/349.1 |
| 5,749,295 | A * | 5/1998 | Kurz | 101/350.1 |
| 6,202,556 | B1 * | 3/2001 | Lagger | 101/216 |
| 6,293,199 | B1 * | 9/2001 | Gasparrini et al. | 101/487 |
| 6,505,557 | B2 * | 1/2003 | Desaulniers et al. | 101/487 |
| 6,765,941 | B2 * | 7/2004 | Nolan | 372/35 |
| 6,868,788 | B2 * | 3/2005 | Henning et al. | 101/487 |
| 7,581,334 | B2 * | 9/2009 | Majima | 34/212 |
| 7,901,063 | B2 * | 3/2011 | Wouters et al. | 347/89 |
| 8,272,324 | B2 * | 9/2012 | Muller et al. | 101/487 |

FOREIGN PATENT DOCUMENTS

| | | |
|---|---|---|
| DE | 103 16 860 | 10/2004 |
| EP | 0 693 372 | 1/1996 |
| EP | 0 693 375 | 1/1996 |
| EP | 0 699 525 | 3/1996 |

* cited by examiner

METHOD AND DEVICE FOR CONTROLLING THE TEMPERATURE OF INKING GROUPS AND DAMPENING SOLUTION OF AN OFFSET PRINTING PRESS

RELATED APPLICATION DATA

This U.S. National Phase Application is based on and claims priority benefit of international application no. PCT/EP2007/002309 filed on Mar. 16, 2007, which claimed priority benefit of German national patent application nos. 10 2006 028 292.2 filed on Jun. 20, 2006 and 10 2006 014 115.6 filed on Mar. 24, 2006.

FIELD OF THE DISCLOSURE

The invention concerns a method for controlling the temperature of inking groups and of dampening solution of an offset printing press, wherein a heat transfer medium that is circulated through the inking groups in an inking group temperature control circuit for the temperature control of the inking groups is cooled as needed, and wherein the dampening solution that is circulated through dampening systems of the offset printing machine in a dampening solution circuit for the temperature control of the dampening solution is cooled as needed. Furthermore, the invention is concerned with a device for the temperature control of inking groups and of dampening solution of an offset printing press, with an inking group temperature control circuit for passing a heat transfer medium through the inking groups of the offset printing press, with a dampening solution circuit for passing the dampening solution through dampening systems of the offset printing press, as well as with a cooling device for cooling the heat transfer medium and/or the dampening solution, whereby the cooling system comprises a heat exchanger.

DESCRIPTION OF THE RELATED ART

In order to keep the printing inks in the printing systems of offset printing presses at a desired temperature set by the printer, at which they have an optimum viscosity for printing, the inking groups of offset printing presses are usually temperature controlled. As a rule, the offset printing presses are equipped for this purpose with an inking group temperature control circuit, in which a heat transfer medium in the form of a water-glycol solution is circulated. The circuit comprises a heating device and a cooling device so that the circulated heat transfer medium can be heated or cooled as needed to increase or decrease the temperature of the ink in the inking groups.

The same applies to the dampening solution used in offset printing presses, which solution becomes heated during printing and therefore has to be temperature controlled by cooling in order to keep it at the temperature desired or set by the printer, usually in the range from 8 to 15° C. The temperature control or cooling of the dampening solution is usually done during treatment of the contaminated dampening solution after its passage through the dampening systems and collection in a dampening solution collecting tank in a dampening solution treatment plant equipped with a cooling system.

In the known offset printing presses both the cooling system for cooling the heat transfer medium in the inking group temperature control circuit and the cooling system for cooling the dampening solution in the dampening solution circuit each comprise a heat exchanger through which the heat transfer medium or the dampening solution respectively flows, as a rule a plate heat exchanger, whereby frequently a coolant is supplied to these heat exchangers from a single, common cooling aggregate.

However, such cooling devices have the disadvantage that, due to the necessarily intermittent feeding of the heat transfer medium or of the dampening solution to the respective heat exchanger, an undesirable, wavy temperature course occurs in the inking group temperature control circuit and in the dampening solution circuit. In the case of the dampening solution circuit this wavy temperature course can be smoothened by having the treatment plant comprise an internal dampening solution tank acting as heat storage from which dampening solution is passed through the heat exchanger for cooling. However, this internal dampening solution tank on the one hand increases the volume of the dampening solution circulated in the dampening solution circuit and, on the other, requires a relatively large space. Another problem consists in the fact that plate heat exchangers react relatively sensitively to contaminants in the media passed through them, so that the dampening solution must always be filtered before its passage through the heat exchanger.

SUMMARY

Based on this, the task of the invention is to improve a method and a device of the type mentioned at the outset so that the temperature course in the inking group temperature control circuit and in the dampening solution circuit is smoothened and so that at the same time the amount of the dampening solution contained in the dampening solution circuit can be reduced.

Regarding the method this task is solved by the fact that a part of the heat transfer medium is cooled to a temperature below a target temperature of the dampening solution in the dampening systems and brought in a heat exchanger into heat exchange contact with dampening solution from the dampening solution circuit, while, regarding the device, it is proposed that the heat exchanger is supplied with cooled heat transfer medium and dampening solution to be cooled.

The cooled heat transfer medium in the heat exchanger forms a cold storage that can be used not only for the cooling of the dampening solution by heat exchange but also for the cooling of the heat transfer medium in the inking group temperature control circuit, by dosing the cooled heat transfer medium from the heat exchanger into the considerably warmer heat transfer medium in the inking group temperature control circuit.

According to a preferred embodiment of the invention, the heat exchanger comprises a storage container that is at least partly filled with the cooled heat transfer medium, through which a coiled pipe of the dampening solution circuit passed by dampening solution extends. In contrast to a plate heat exchanger, in this way even when the dampening solution is contaminated, adverse effects on the heat transfer in the heat exchanger can be avoided.

Expediently, the storage container has a volume of more than 50 liters and preferably more than 100 liters, as a result of which a relatively large cold storage is provided. This permits first of all the compensation of temperature changes of the dampening solution in the dampening solution circuit. Secondly, by dosing cooled heat transfer medium from the storage container into the inking group temperature control circuit, it is possible to rapidly counteract an undesirable heating of the heat transfer medium in the inking group temperature control circuit, without the occurrence of any large temperature fluctuation of the heat transfer medium contained in the storage container.

The dosing of the cooled heat transfer medium from the storage container into the inking group temperature control circuit is preferably done via a mixing valve, preferably a three-way mixing valve with two inputs and one output, whereby one input and the output are connected to the inking group temperature control circuit, while the other input communicates with the storage container.

The mixing valve is preferably controlled with a suitable control device as a function of the temperature of the printing ink or of the heat transfer medium, preferably of its return temperature. Hereby the amount of the heat transfer medium passing through the mixing valve, more accurately through the exit of the mixing valve, is expediently kept constant, while the temperature of the heat transfer medium leaving the mixing valve is adjusted by changing the valve setting of the mixing valve to a desired value.

Since during the dosing of the cooled heat transfer medium into the inking group temperature control circuit warm heat transfer medium is displaced from it, the inking group temperature control circuit according to an advantageous embodiment of the invention is designed as an open or closed circuit and has an overflow opening into the storage container through which the displaced heat transfer medium can flow into the storage container. The relatively large volume of the storage container also ensures even in this case that the warmer heat transfer medium that flows into it will not cause a large temperature fluctuation of the heat transfer medium in the storage container.

The cooling of the heat transfer medium contained in the storage container is preferably done with the aid of a cooling aggregate via a second heat exchanger, whereby the latter is preferably designed as a plate heat exchanger and can be supplied on the one hand with cooling agent from the cooling aggregate and on the other hand with heat transfer medium from the storage container.

Expediently, a part of the content of the storage container is cooled during the passage through the second heat exchanger to the point that the temperature of the heat transfer medium in the storage container is at least 5° C. below a desired target temperature of the dampening solution in the dampening systems. This ensures that the dampening solution passed through the cooling coil is cooled to the desired value even in the case of strong warming.

Hereby the cooling performance of the cooling aggregate is adjusted expediently to the particular offset printing press, that is, to the heat uptake of the dampening solution in the dampening solution circuit and to the heat uptake of the heat transfer medium in the inking groups, in such a way that the cooling aggregate can be essentially operated continuously, and fluctuations of the heat uptake due to the volume of the heat transfer medium in the storage container can be buffered.

The dampening solution circuit comprises in a conventional way a dampening solution collecting tank in which the used dampening solution from the dampening systems is collected, as well as a dampening solution pump connected after the dampening solution collecting tank for circulating the dampening solution. In order to avoid that the entire dampening solution has to be passed through the dampening systems as well as through the heat exchanger, the dampening solution circuit expediently branches after the pump into two partial circuits, the first one of which comprises the dampening systems and the second the heat exchanger. In order to filter the contaminated dampening solution, a dampening solution filter is used which is arranged either in the partial circuit with the heat exchanger in order to filter the partial stream flowing through the heat exchanger in a partial stream process, or directly after the dampening solution pump, in order to purify in a full stream method not only the partial stream that flows through the heat exchanger but also the partial stream that flows through the dampening systems.

In order to control the amounts that flow through the two partial circuits, expediently the first partial circuit has a pressure hold valve arranged between the pump and the dampening systems, and this valve opens when the pressure in the dampening systems drops and closes when the pressure in the dampening systems increases so that only as much dampening solution is introduced to the dampening systems as necessary, while the rest of the dampening solution is passed through the second partial circuit and the heat exchanger back into the dampening solution collecting tank.

In the second partial circuit, in addition to temperature control of the dampening solution in the heat exchanger, preferably conditioning of the dampening solution in a dampening solution treatment plant can be performed, in which, for example, additives are added to the dampening solution.

BRIEF DESCRIPTION OF THE DRAWINGS

Below the invention will be explained in more detail with the aid of a practical example shown in the drawing. The following are shown.

DETAILED DESCRIPTION OF THE DISCLOSURE

Figure 1:
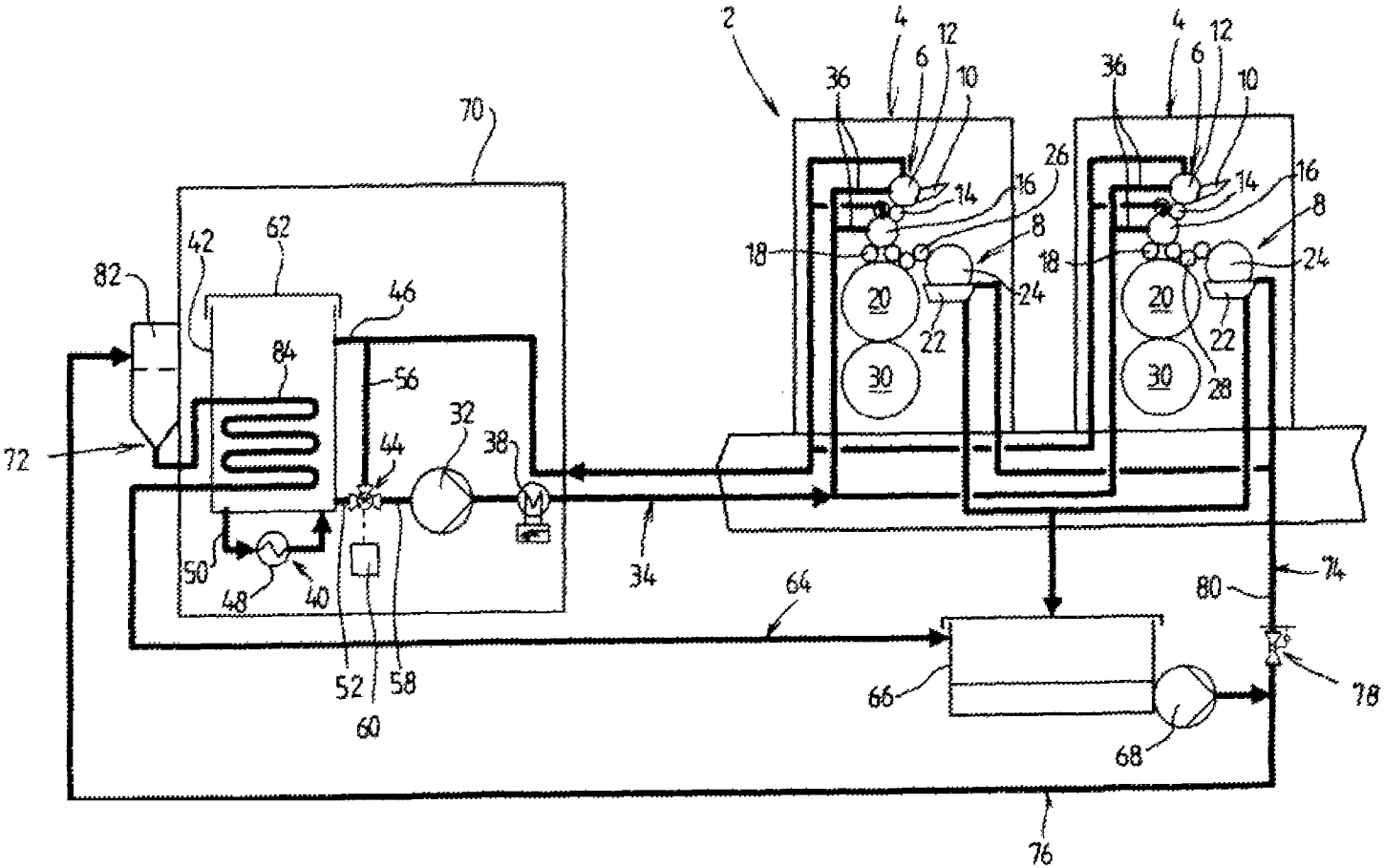
FIG. 1: is a schematic representation of a combined inking group and dampening solution temperature control device of an offset printing press.

The multi-color rotation offset printing press 2 shown only partially in the drawing comprises several printing systems 4, of which two are shown schematically. As is well known, each printing system 4 has an inking group 6 and a dampening system 8. Each of the inking groups 6 comprises an inking box 10 from which a printing ink is transferred by an ink ductor 12 through several spreading rollers 14, ink spreading cylinders 16 and application rollers 18 (only partly shown) onto a plate cylinder 20 holding a printing plate. The dampening systems 8 are each equipped with a dampening solution box 22 from which dampening solution is taken up by a dampening ductor 24 and transferred through a chromium roll 26 and a dampening solution applicator roll 28 onto the printing plate attached to the plate cylinder 20, from where the dampening solution as well as the printing ink is transferred by means of a rubber blanket cylinder 30 onto a sheet of paper on a neighboring printing cylinder (not shown).

In order to ensure that the printing ink has the optimum temperature and thus optimum viscosity for printing, the inking groups 6 of the printing press 2 are temperature controlled. For this purpose a heat transfer medium, in the form of a water-glycol mixture, is circulated by a pump 32 through an inking group temperature control circuit 34 and through branch lines 36 to the inking groups 6. The inking group temperature control circuit 34 comprises an electrical heating device 38 connected after the pump 30, with the aid of which the heat transfer medium circulating through the inking group temperature control circuit 34 can be heated as needed, in order to increase the temperature of the printing ink, a cooling device 40, with the aid of which heat transfer medium located in a separate storage container 42 can be cooled in order to reduce the temperature of the printing ink, a mixing valve 44 for dosing cooled heat transfer medium from the storage container 42 into the inking group temperature control circuit 34, as well as an overflow 46 through which the heat transfer medium hereby displaced from the inking group temperature control circuit 34 can flow into the storage container 42.

The pump 32 and the heating device 38 correspond to those of conventional inking group temperature control circuits and therefore will not be described here further in detail.

The cooling device 40 consists essentially of a cooling aggregate (not shown) as well as a plate heat exchanger 48 which can be supplied with cooling agent from the cooling aggregate. The heat exchanger 48 is arranged along a bypass line 50 which branches off from the storage container 42 and opens again into the storage container 42, through which heat transfer medium from the storage container 42 can be circulated by a circulating pump (not shown), whereby it is cooled in the heat exchanger 48 by heat exchange with the cooling agent. The cooling performance of the cooling aggregate is designed so that during a continuous operation of the cooling aggregate the temperature of the heat transfer medium inside the storage container 42 is held at a value which is about 5° C. below a desired target temperature of the dampening agent in the dampening systems 8.

The mixing valve 44 consists of a controllable three-way valve, which has two inputs and one output. While one of the inputs is connected to a dosage line 52 opening near the bottom of the storage container 42 into the storage container 42, the other input is connected to a return 56 of the inking group temperature control circuit 34 after the overflow 46. The outlet is connected to the input of pump 32 through a line section 58 of the inking group temperature control circuit 34. The control of the mixing valve 44 is done with the aid of a control 60, for example a PID controller. Hereby the valve setting of the mixing valve 44 is changed as a function of the target temperature and the actual temperature of the heat transfer medium in the inking groups 6 and/or in the return 56 of the inking group temperature control circuit 34, whereby in case of a constant amount of flow through the output of the mixing valve 44 more or less cooled heat transfer medium is dosed from the storage container 42 into the inking group temperature control circuit 34 depending on the desired degree of cooling of the heat transfer medium.

In the case of the storage container shown in FIG. 1, we are dealing with a vertical cylindrical tank, the upper open end of which is closed with a cover 62 laid onto it so that here we are dealing with an open circuit in the inking group temperature control circuit 34.

The dampening solution used in the dampening systems 8 of the offset printing press 2 consists essentially of a mixture of water and isopropanol as well as, optionally, surfactants that serves for wetting the non-printing surface areas of the printing plate on the plate cylinder 20. Since during a printing process dampening solution from the dampening solution boxes 22 of the dampening systems 8 is used up, and in addition the dampening solution becomes contaminated and heated in the dampening solution boxes 22, the dampening solution boxes 22 are connected to a dampening solution circuit 64 through which the contaminated and heated dampening solution is removed from the dampening solution boxes 22 and is replaced by fresh dampening solution.

The dampening solution circuit 64 comprises, in the usual manner, a dampening solution collecting tank 66, in which the contaminated dampening solution from all the dampening systems 8 is collected and eventually subjected to a rough cleaning, a dampening solution pump 68 for circulating the dampening solution through the dampening solution circuit 64, as well as dampening solution treatment plant 72 which is arranged in an equipment box 70 together with the storage container 42, the mixing valve 44, the pump 32 and the heating device 38 of the inking group temperature control circuit 34, where conditioning of the dampening solution including temperature control are performed.

In the offset printing press 2 shown, the dampening solution circuit 64 branches after the dampening solution pump 68 into two partial circuits 74, 76, through which part of the dampening solution conveyed by pump 68 is pumped back through the dampening systems 8 or through the dampening solution treatment plant 72 into the collecting tank 66 respectively. The control of the amounts of flow through the two partial circuits 74, 76 is done with the aid of a pressure hold valve 78 in a line section 80 of the partial circuit 74 leading from pump 68 to the dampening systems 8. This pressure hold valve 78 opens when the pressure after valve 78, that is, on the side of the dampening systems 8, drops, as a result of which a larger fraction of the dampening solution is conveyed through the dampening systems 8, and closes when the pressure increases there, as a result of which a larger fraction of the dampening solution is conveyed through the treatment plant 72.

The treatment plant 72 shown in FIG. 1 comprises, among other things, a pressure filter 82 for the partial flow filtration of the dampening solution conveyed by the pump 68 through partial circuit 76, as well as a cooling coil 84 arranged in the storage container 42, through which the dampening solution flows after its passage through the pressure filter 82 back into the dampening solution collecting tank 66. Since the temperature of the heat transfer medium contained in storage container 42, which surrounds the cooling coil 84, is about 5° C. below the target temperature of the dampening solution in the dampening systems 8, the dampening solution is cooled as it passes through the cooling coil 84, whereby the higher the temperature difference between the temperature at the inlet of the cooling coil 84 and the target temperature in the dampening systems 8 the stronger the cooling. Thus, the storage container 42 with the cooling coil 84 forms a heat exchanger, in which the dampening solution circulating through partial circuit 76 is cooled by heat exchanger contact with the cooled heat transfer medium in the storage container 42 acting as cold storage.

Figure 2:
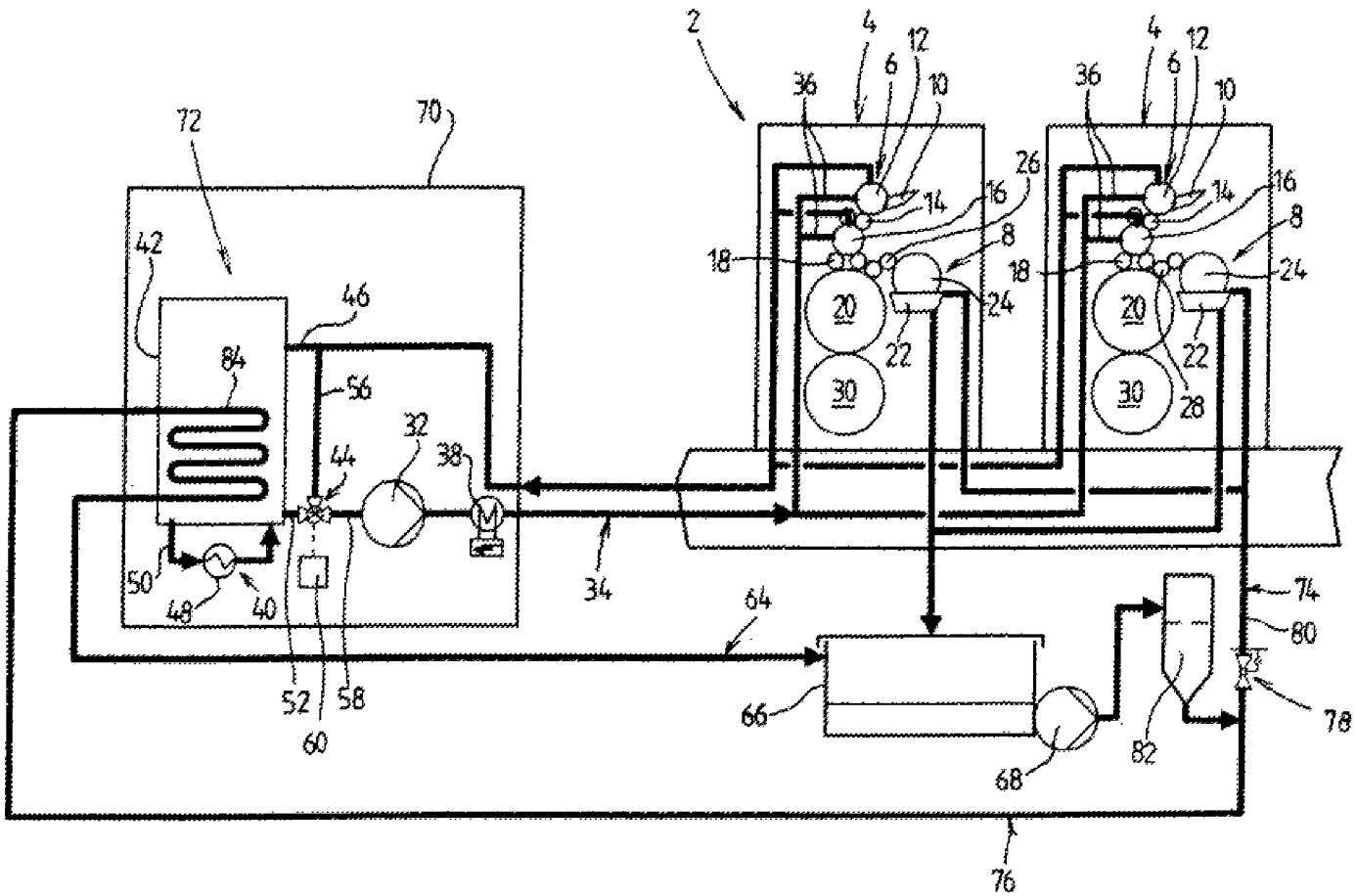
FIG. 2: is a schematic representation of a somewhat modified inking group and dampening solution temperature control device.

In contrast to that, in the dampening solution circuit 64 shown in FIG. 2, a full stream filtration of the total dampening solution circulated by pump 68 occurs in a pressure filter 82, which is arranged for this purpose after pump 68 and before the branching out of the two partial circuits 74, 76.

Furthermore, the inking group temperature control circuit 34 shown in FIG. 2 is a closed circuit in which the storage container 42 is designed as a closed tank.

The invention claimed is:

1. Method for the temperature control of inking groups and of a dampening solution in an offset printing press, wherein, a) a heat transfer medium is cooled and circulated through the inking groups in order to control the temperature of the inking groups, b) the dampening solution is circulated through a dampening system of the offset printing press in order to control the temperature of the dampening solution, c) wherein the dampening solution is cooled by at least a part of the heat transfer medium that is brought into heat exchange contact with dampening solution from the dampening system, and d) said part of the heat transfer medium is first cooled to a temperature that is at least 4° C. below a target temperature of the dampening solution in the dampening system, and then is brought into heat exchange contact with the dampening solution from the dampening system.

2. Method according to claim 1, wherein the heat transfer medium is dosed from the heat exchanger into the inking group temperature control circuit in order to reduce the temperature of the heat transfer medium that is circulated in the inking group temperature control circuit.

3. Method according to claim 2, wherein the heat transfer medium is dosed from the heat exchanger through a mixing valve into the inking group temperature control circuit.

4. Method according to claim 3, wherein the mixing valve is controlled as a function of a target temperature and an actual temperature in at least one inking group or in the inking group temperature control circuit.

5. Method according to claim 3, wherein the amount of heat transfer medium flowing through an outlet of the mixing valve is kept constant.

6. Method according to claim 2, wherein the heat transfer medium that is displaced from the inking group temperature control circuit when dosing is passed into the heat exchanger.

7. Method according to claim 1, wherein, in order to cool the heat transfer medium located in the heat exchanger, a part of this heat transfer medium is passed through a second heat exchanger, which is supplied with cooling agent from a cooling aggregate.

8. Method according to claim 7, wherein the cooling aggregate is operated essentially continuously in order to keep the temperature of the heat transfer medium located in the heat exchanger at a desired value.

9. Device for controlling a temperature of inking groups and a temperature of a dampening solution of an offset printing press, the device comprising:

an inking group temperature control circuit for passing a heat transfer medium through the inking groups of the offset printing press;

a dampening solution circuit for passing the dampening solution through a dampening system of the offset printing press;

a heat exchanger coupling the heat transfer medium supplied to the inking groups and the dampening solution supplied to the dampening system; and a cooling device configured to cool the heat transfer medium being in the heat exchanger, wherein the heat exchanger is configured to cool at least part of the heat transfer medium to a temperature at least 4° C. below a target temperature of the dampening solution in the dampening system and then to circulate the cooled part of the heat transfer medium to dampening solution to be supplied to the dampening system.

10. Device according to claim 9, further comprising a mixing valve arranged in the inking group temperature control circuit and communicating with the heat exchanger, through which cooled heat transfer medium is dosed as needed from the heat exchanger into the inking group temperature control circuit.

11. Device according to claim 10, wherein the mixing valve is a three-way valve with two inlets and one outlet, whereby one inlet and the outlet are connected to the inking group temperature control circuit and the other inlet communicates with the heat exchanger.

12. Device according to claim 10, further comprising a control device for controlling the valve setting of the mixing valve as a function of a target temperature and an actual temperature in at least one of the inking groups and/or in the inking group temperature control circuit.

13. Device according to claim 9, wherein the heat exchanger comprises a storage container for the cooled heat transfer medium, and wherein a heat exchanger pipe forming part of the dampening solution circuit extends through the storage container.

14. Device according to claim 13, wherein the storage container has a volume of more than 50 liters.

15. Device according to claim 13, wherein the inking group temperature control circuit comprises an overflow that opens into the storage container.

16. Device according to claim 13, wherein the inking group temperature control circuit comprises a circulating pump arranged downstream of the mixing valve.

17. Device according to claim 1, wherein the inking group temperature control circuit comprises a heating device for heating the heat transfer medium.

18. Device according to claim 1, wherein the cooling device serves to cool the heat transfer medium in the heat exchanger and comprises a cooling aggregate.

19. Device according to claim 18, wherein the cooling device comprises a second heat exchanger that is supplied with cooling agent from the cooling aggregate and with heat transfer medium from the heat exchanger.

20. Device according to claim 18, wherein the dampening solution circuit comprises a dampening solution collecting tank and a dampening solution pump connected downstream of the dampening solution collecting tank.

21. Device according to claim 1, wherein the dampening solution circuit comprises a dampening solution filter.

22. Device according to claim 1, wherein the dampening solution circuit branches into two partial circuits, one of which comprises the heat exchanger and the other of which comprises the dampening system.

23. Device according to claim 22, wherein the dampening solution circuit includes a dampening solution filter that is arranged upstream of the branching of the two partial circuits.

24. Device according to claim 22, wherein the partial circuit with the dampening system comprises a pressure hold valve arranged upstream of the dampening systems, this valve opening when the pressure in the dampening systems drops and closing when the pressure in the dampening systems increases.

25. Device according to claim 22, wherein the dampening solution circuit includes a dampening solution filter that is arranged downstream of the branching in the partial circuit with the heat exchanger.

* * * * *